United States Patent [19]

Kopp

[11] Patent Number: 4,465,112

[45] Date of Patent: Aug. 14, 1984

[54] DEVICE FOR FILLING TONER FROM A CONTAINER INTO A RESERVOIR

[75] Inventor: Walter Kopp, Taufkirchen, Fed. Rep. of Germany

[73] Assignee: Siemens Aktiengesellschaft, Berlin & Munich, Fed. Rep. of Germany

[21] Appl. No.: 369,886

[22] Filed: Apr. 19, 1982

[30] Foreign Application Priority Data

Apr. 28, 1981 [DE] Fed. Rep. of Germany ..... 3116870

[51] Int. Cl.[3] ..... B65B 1/04

[52] U.S. Cl. ..... 141/284; 141/364

[58] Field of Search ..... 141/250-284, 141/363, 364, 365, 366, 369-389, 129-191, 100-110, 2, 18; 414/758, 770

[56] References Cited

U.S. PATENT DOCUMENTS 2,201,634 5/1940 Shurts ..... 141/364
3,784,297 1/1974 Ito et al. .
3,883,240 5/1975 Ito et al. .

*Primary Examiner*—Houston S. Bell, Jr.

*Attorney, Agent, or Firm*—Hill, Van Santen, Steadman & Simpson

[57] ABSTRACT

Apparatus for the clean filling of toner from a container into a developer station reservoir in a non-mechanical printing or copying machine comprises a laterally disposed guide trough having a centering portion at one end and a seating surface disposed adjacent the fill opening of the reservoir at the other end. A pivot recess is disposed between the centering trough and the seating surface to provide a pivot line about which a container can be laterally inverted from an initial upstanding position in the centering trough to a laterally disposed position in the seating surface with the container opening overlying the fill hole. Subsequently, the container is vertically inverted into the fill hole where the discharge end of the container rests against stop pins disposed in the hole. The reservoir hole is provided with a pivotable cover member which is upraised during filling operation and is provided with bracket surfaces which form a mount for the vertically inverted container, allowing the container to be shaken without risking that the container will slip out of the fill hole.

11 Claims, 6 Drawing Figures

DEVICE FOR FILLING TONER FROM A CONTAINER INTO A RESERVOIR

BACKGROUND OF THE INVENTION

The invention relates to apparatus for filling a toner particle supply reservoir from which toner is withdrawn for use in a non-mechanical printer or copier machiner developer station.

According to electrophotographic principles typically utilized in non-mechanical copying or printing machines, electrostatic charge images of characters to be printed are generated on a recording medium, such as a photoconductive drum or specially treated paper. These charge images are subsequently inked with a print powder, called toner particles and which is typically black, in a developer station. The developer station typically includes at least one developer unit generally referred to in the art as a magnetic brush developer. A magnetic brush developer, as a rule, utilizes a two-component magnetizable developer mix for developing the latent charge images recorded on the recording medium. The two components of the developer mix consist of ferromagnetic carrier particles and toner powder particles. The magnetic brush arrangement serves to conduct developer mix particles passed the charge images formed on the recording medium, whereupon the toner adheres to the charge images as a result of electrostatic forces. Electrophotographic principles are conventionally known. One such electrophotographic copying machine construction is disclosed, for example, in U.S. Pat. Nos. 3,784,297 and 3,883,240.

As a result of the process whereby charge images are inked in the developer station, the concentration of toner particles within the developer mix, i.e., the percentage of toner particles relative to carrier particles is constantly decreasing in the developer as the toner is used up. It is, therefore, necessary to constantly or frequently supply new toner to the developer mix. Typically, this replenishment of the toner supply is carried out in metered fashion. Since the rate of consumption of toner is very high in fast copying machines and high-performance data printers, a spacious toner reservoir is typically employed in connection with the developer stations in order to avoid downtime during the resupplying of toner. When this toner reservoir is empty, it is typically re-filled from handy containers or bags containing toner particles. This re-filling step is carried out manually and it is necessary, since spilled toner can be messy and can interfere with the copier or printer machinery, to carry out this step in a manner which substantially precludes loose toner particles from ending up outside of the reservoir.

An object of the present invention is to provide a toner re-filling apparatus whereby the re-supply of toner particles is assured to pass only into the reservoir, such that messy spillage or machinery contamination with toner about the reservoir is no longer possible.

SUMMARY OF THE INVENTION

Apparatus for assuring a clean re-filling of a toner reservoir connected to a developer station comprises a guide trough element disposed on the printing or copying machine adjacent to the fill opening leading to the toner reservoir. A container, which may be a disposable container carrying toner particles and having an upper end discharge opening is placed at one end of the guide trough in an upstanding condition. The opposed end of the guide trough is formed as a seating surface for receiving the upper end of the container tipped over or inverted from its original upstanding position. The discharge opening of the container inverted on the seating surface is disposed over the fill opening of the reservoir. The fill opening of the reservoir has a cross-sectional area for fully receiving therein the entire cross-section of the upper part of the container such that the container can then be turned upside down with its discharge opening fully disposed into the reservoir fill hole.

In order to facilitate tipping over of the container in the guide trough, there is provided a pivot recess for receiving an edge corner of the container as the container is tipped from its upstanding position at one end of the guide trough to its lateral position on the seating surface. In accordance with the preferred embodiment, the pivot recess is disposed between the initial, centering end of the guide trough and the seating surface. In order to avoid lateral shifting of the container at the centering end of the guide trough, the trough there is formed of a bottom or base wall and upstanding surrounding lateral walls defining an opening facing into the pivot recess. The seating surface is formed of a bottom or base wall and laterally opposed upstanding guide walls for receiving the inverted container therebetween.

Overlying the reservoir fill opening there is provided a pivotable cover member seated at that edge of the reservoir opening opposite the seating surface. When the reservoir is not being refilled, the cover is disposed laterally across the opening to substantially seal the opening from ambient. When the reservoir is to be refilled from toner contained in the container, the cover member is raised to an upstanding position such that it forms a mounting surface for the container which is to be turned upside down facing directly into the reservoir opening. For this purpose, the cover is formed with laterally facing bracket walls which contain the container disposed in the reservoir opening against lateral shifting. Stop pins extend inwardly along the sidewalls of the reservoir opening for supporting the upper end of the container in its vertically inverted state. The pivotal mounting of the reservoir cover along with the stopping support of the upper end of the container makes it possible to shake the container in its vertically inverted state to obtain a substantially free flow of toner particles into the reservoir opening.

In order to avoid emergence of toner dust from the reservoir opening during re-filling operation, conduits connected to a source of suction pressure communicate with the reservoir opening sidewalls. The suction pressure need only be switched on when the reservoir is being filled from the container and this control is preferably brought about by a microswitch means disposed adjacent the exterior of the reservoir opening for switching on the suction pressure when the cover member is raised.

DESCRIPTION OF THE PREFERRED EMBODIMENT

Figure 1:
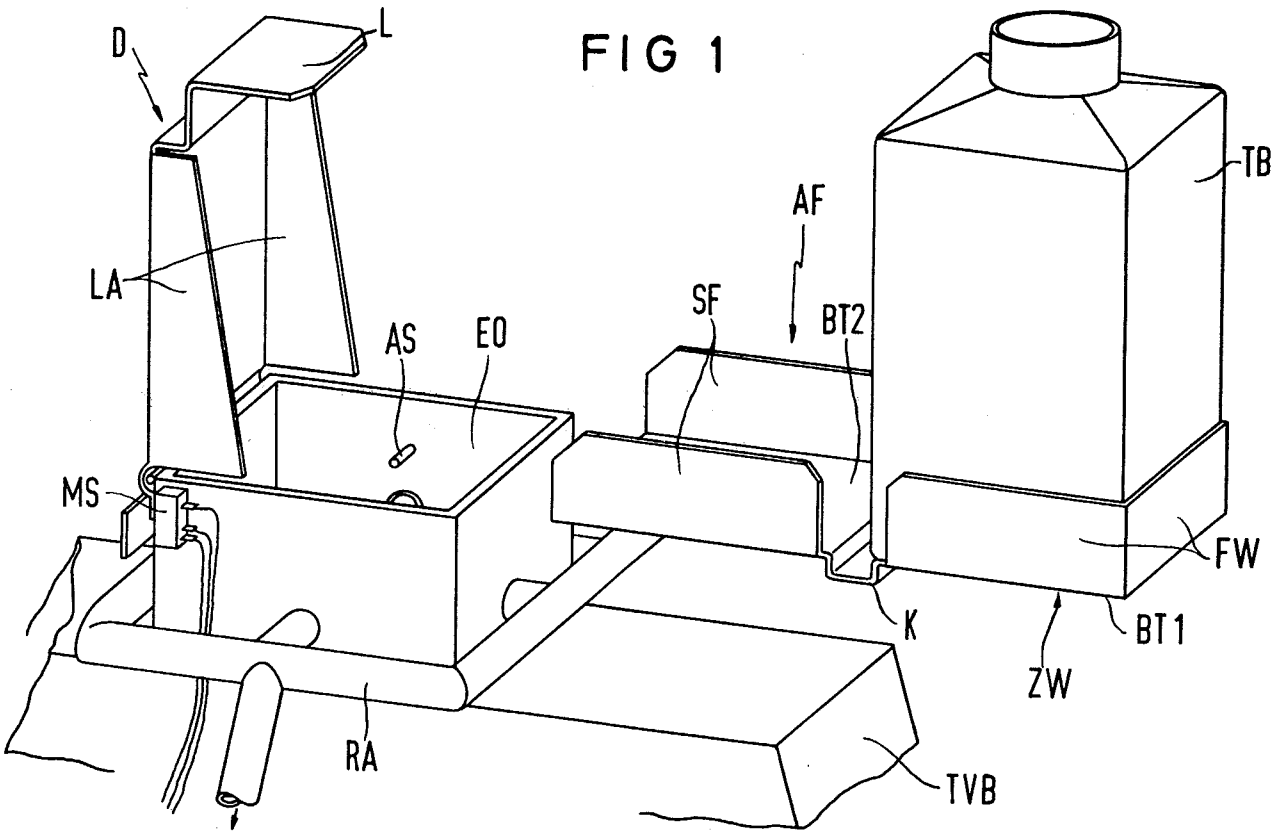
FIG. 1 is a perspective view of toner filling apparatus constructed in accordance with the present invention.

FIG. 1 illustrates toner re-filling apparatus mounted on an electrophotographic printing or copying machine overlying a toner reservoir TVB connected to the developer station of the machine. The reservoir TVB is formed with an upwardly directed fill hole EO having a rectangular cross-section.

The re-fill apparatus comprises a laterally disposed guide trough having a shelf or centering portion ZW and a seating surface portion AF. The centering portion ZW is adapted to receive a container TB containing a supply of toner particles. The centering portion ZW comprises a base or bottom surface BT1 and upstanding lateral walls FW which surround the base surface on three sides leaving an opening facing in the direction of the seating surface AF. The container TB is formed of a substantially rectangular cross-section having a flat bottom wall and an upper end dome portion containing a vertically directed discharge opening or mouth. By virtue of the lateral walls FW, the container TB can be placed on the base surface BT1 of the centering trough such that the container is secured against lateral shifting or twisting and the suitable cap or seal across the container mouth can be opened without difficulty. The seating surface AF comprises a base or bottom part BT2, which may lie substantially in the same plane as the centering trough base surface BT1. Two opposed lateral upstanding guide walls SF serve to define a guide trough area therebetween which is substantially equal to the width of the container TB. The seating surface AF is disposed with its lead edge facing toward the fill hole EO of the reservoir TVB in such a manner that, when the container TB is tilted and laid on its side, the mouth opening of the container is disposed directly overlying the fill hole EO.

In order to facilitate tipping of the container TB within the guide trough at a predetermined location, there is formed a pivot recess K disposed between the centering trough ZW and the seating surface AF. When the container TB is tilted, the adjacent lead edge of the container TB proceeds into the pivot recess K. Accordingly, the pivot recess K serves as the set pivot line about which the container TB is tilted to its inverted side position.

During normal operation of the toner reservoir TVB, a pivotable cover member D seated for rotation along the edge of the fill hole AE opposed from the seating surface SF is laterally disposed across the open end of the fill hole EO to substantially seal the reservoir TVB from ambient. The cover D is rotated to its upraised position as shown in FIG. 1 to permit re-fill feeding of toner through the fill hole EO and into the reservoir TVB. During toner filling operation, the container TB is positioned upside down in the reservoir hole EO such that the mouth end of the container is disposed within the confines of the fill opening EO. The upper dome part of the container TB is vertically supported on inwardly directed stop pins AS protruding from the sidewalls which define the fill hole EO. These stop pins AS limit the penetration of the container TB into the opening EO and support the container in a manner which allows the container to be shaken in order to facilitate the free flow emergence of toner. In its upraised state, the cover D serves as a mounting bracket for the vertically inverted container TB disposed in the fill hole EO. In this regard, the cover D is provided at its upper free end with a bracket surface L adapted to confine the bottom wall of the container from being pulled vertically outward from the fill hole EO as it empties its contents into the reservoir TVB. The cover D is further provided with opposed lateral bracket walls LA which confine the inverted container TB against twisting, turning, or pivoting out of the opening EO in the lateral direction. By virtue of the pivotal mounting of the cover D, it is possible to shake the container in its vertically inverted state while being confined by the bracket walls of the cover D without any danger that the container will slide out of the fill hole EO and spill toner particles in the machinery or otherwise about the area of the reservoir TVB.

As further precaution against contamination of the reservoir exterior with toner dust arising out of the fill opening EO, tubes or conduits RA connected to a suitable source of suction pressure are disposed about the sidewalls of the opening AE with open ends facing into the confine of the hole. Whenever the cover D is raised to permit toner filling, the suction pressure is turned on so that toner dust or backed up toner particles which might attempt to emerge out of the fill hole can be conducted from the fill opening EO before spilling out onto the reservoir exterior area. In this regard, a suitable microswitch MS is disposed adjacent the exterior surface of the fill opening EO in a manner such that the microswitch MS is triggered when the cover D is upraised. Triggering of the microswitch MS causes the suction means to switch on.

Figure 2:
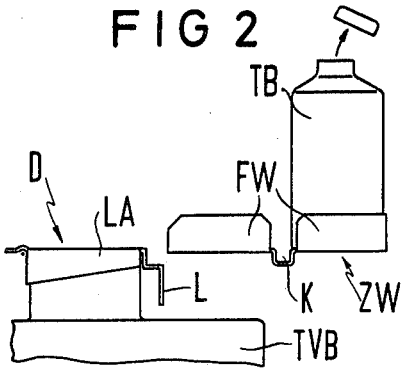
FIGS. 2–6 are a series of schematic, side elevational views of the apparatus of FIG. 1 at various points in time during the filling operation.
Figure 3:
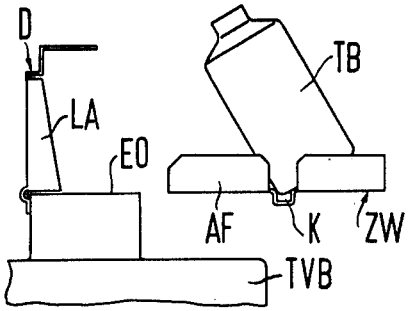
Figure 4:
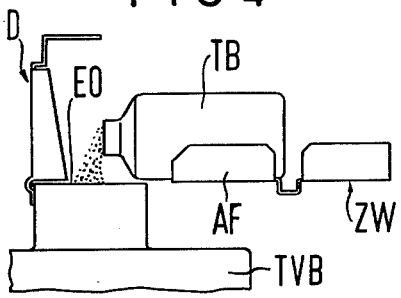

FIGS. 2–6 illustrate in step-by-step fashion the manner in which toner is fed to the reservoir TVB as a result of the toner re-fill apparatus of the present invention. FIG. 2 shows the initial state of the re-fill apparatus preparatory to filling of the reservoir. The container TB is disposed in the centering trough ZW and the suitable cap or cover seal of the container is opened or removed. At this point, the cover D to the reservoir opening EO is in its laterally disposed closed state. In FIG. 3, the cover D has been opened to its upstanding state and the container TB is now pivoted in the pivot recess K until it comes to lie on its side in the seating surface AF as shown in FIG. 4. As shown in FIG. 4, the mouth opening of the container TB is disposed directly over the fill hole EO and toner emerges from the container falling into the reservoir TVB.

Figure 5:
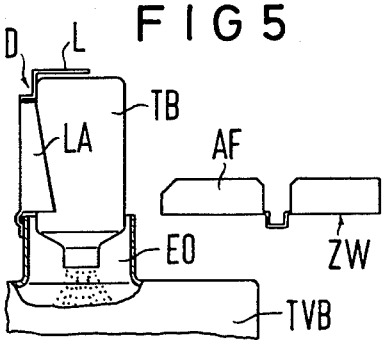
Figure 6:
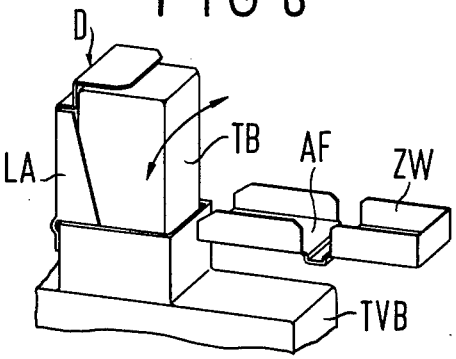

As shown in FIG. 5, the container TB is subsequently inverted into the fill hole EO so that the toner can fall from the container TB into the reservoir. In this position, the cover D with its bracket surfaces L and LA forms a mount for confining the container TB against lateral and vertically upward movement within the opening EO as it rests on the stop pins AS. The container TB can now be shaken in order to facilitate the emergence of the toner without any danger that the container TB will leave the reservoir opening AE. FIG. 6 also illustrates this state in the fill operation and indicates by arrows how the container TB can be shaken to increase the free flow of toner from the container into the reservoir. Shaking of the container also, due to the up and down movement, produces significant air velocities and turbulence between the fill hole and the discharge end of the container TB causing toner dust to emerge in the area of the fill hole EO where is can be extracted through the suction tubing RA.

As further illustrated in FIG. 6, the container TB can only be tipped into the fill opening EO preceeding from the lead edge of the seating surface AF. The disposition of the bracket surfaces LA formed on the cover D enables the operator to have a clear view of the fill hole EO, so as to judge how the emptying of the container TB is proceeding and also whether or not another fill will fit into the reservoir TVB.

Although various minor modifications may be suggested by those versed in the art, it should be understood that I wish to embody within the scope of the patent warranted hereon all such modifications as reasonably and properly come within the scope of my contribution to the art.

I claim as my invention:

1. Apparatus for use in an electrophotographic printing device for supplying particle toner from a container having an upper end discharge opening through a fill opening formed in a toner reservoir for a charge image developer station comprising:

a guide trough means disposed adjacent said fill opening comprising a centering portion for supporting said container in an intial upstanding position, a seating portion facing said fill opening for supporting said container in an intermediate lateral position, and a pivot channel means for receiving a lower edge of said container such that said container lower edge rotates in said channel means for movement to an upturned position from the lateral position with said discharge opening disposed in said fill opening, said fill opening sized to receive the upper end of said container therein without toner spilling outside said fill opening as said container is rotated from said lateral position to said upturned position, and mounting means for supporting said container vertically inverted in said fill opening.

2. The apparatus of claim 1, wherein said centering portion comprises a bottom surface surrounded by upstanding walls defining an opening leading to said pivot channel means.

3. The apparatus of claim 2, wherein said seating surface comprises a bottom surface with laterally opposed upstanding sidewalls for supporting said container therebetween.

4. The apparatus of claim 3, wherein said container is rigid and formed with a substantially rectangular plan cross-section.

5. The apparatus of claim 1, wherein said mounting means comprises a plurality of stop pins disposed in said fill opening on which the upper part of said container rests in its vertically inverted position.

6. The apparatus of claim 1, wherein said mounting means comprises a cover pivotably seated on a sidewall of said fill opening opposed from said seating surface for being disposed laterally over said fill opening to substantially seal said reservoir from ambient or upraised from said fill opening to support said container against shifting when vertically inverted in said fill opening.

7. The apparatus of claim 6, wherein said cover is formed with a bracket surface at its free end for limiting upward movement of the bottom wall of said container as said container is vertically inverted in said fill opening.

8. The apparatus of claim 6, wherein said cover is formed with a top surface having laterally extending sidewalls facing toward said fill opening for confining said container vertically inverted in said fill opening against frontwise and sidewise shifting.

9. The apparatus of claim 8, wherein said mounting means further comprises a plurality of support pins disposed in said fill opening on which the upper part of said container rests in its vertically inverted position enabling shaking of said container laterally outward of said upraised cover top surface.

10. The apparatus of claim 6, further comprising tube means connected to a source of suction pressure communicating with the interior of said fill opening and control switch means for turning on said source of suction pressure when said cover is upraised.

11. The apparatus of claim 1, further comprising tube means connected to a source of suction pressure communicating with the interior of said fill opening.

* * * * *